US005595505A

United States Patent [19]

Duke et al.

[11] Patent Number: 5,595,505

[45] Date of Patent: Jan. 21, 1997

[54] ELECTRICAL CONNECTOR FOR CONDUCTIVE LEADS

[75] Inventors: Christopher J. Duke, Enfield; Frank Wheeler-King, Berkhamsted; Michael J. Whelan, Hitchin, all of Great Britain

[73] Assignee: The Whitaker Corporation, Wilmington, Del.

[21] Appl. No.: 426,546

[22] Filed: Apr. 21, 1995

[30] Foreign Application Priority Data

Apr. 27, 1994 [GB] United Kingdom ..... 9408326

[51] Int. Cl.[6] ..... H01R 23/70

[52] U.S. Cl. ..... 439/630; 439/709

[58] Field of Search ..... 439/59, 630, 709, 439/737, 739, 715, 720, 801

[56] References Cited

U.S. PATENT DOCUMENTS 4,174,147 11/1979 Waddington et al. .
4,924,213 5/1990 Decho et al. ..... 439/709 X
5,192,234 3/1993 Heng et al. ..... 439/709 X
5,368,506 11/1994 Heimbrock ..... 439/709 X

FOREIGN PATENT DOCUMENTS 2531278 2/1984 France .
660259A5 3/1987 Switzerland .

*Primary Examiner*—Jes F. Pascua
*Attorney, Agent, or Firm*—Driscoll A. Nina

[57] ABSTRACT

An electrical connector for electrically connecting leads to a device having a contact with a first end for electrically engaging the lead and a second end for electrically engaging the device. The contact is retained within a housing. A fastener maintains engagement of the lead with the contact. The connector being characterized in that the forces exerted to maintain the lead in electrical engagement with the contact by way of the fastener are isolated from the insulative body.

17 Claims, 4 Drawing Sheets

ELECTRICAL CONNECTOR FOR CONDUCTIVE LEADS

BACKGROUND OF THE INVENTION

1. Field of the Invention

This invention relates to an electrical connector for electrically connecting leads, such as insulated wires with or without terminals attached thereto, to an electrical device, such as a printed circuit board.

2. Description of the Prior Art

Conductive leads, such as insulated wire, may be attached to an electrical device, such as the conductive pads of a printed circuit board in a number of ways, for example soldering directly or by way of connectors where the conductive lead is permanently affixed thereto. In some applications, it is desirable to be able to both disconnect the conductive lead from the device, such as by way of a connector, and to be able to disconnect the conductive lead from the contact within the connector. In known connectors of this type, a fastener, for example a screw would hold the conductive lead, or a terminal attached thereto, against a contact, whereby tightening or loosening the fastener engages or releases the conductive lead. A problem with connectors of this type is that the connector housing is typically an insulative body formed of a plastic material and in order to fix the conductive lead against the contact forces must be exerted upon the housing to draw the two components together. When plastic is placed in compression, creep may occur that ultimately allows the conductive lead to become disengaged from the contact, thereby creating an unreliable electrical interconnection.

What is needed is an electrical connector that forms an electrical interconnection between a device and conductive leads, where the leads can be connected and disconnected from the contact within the connector, where any forces exerted to maintain the lead in electrical engagement with the contact are isolated from the insulative body.

SUMMARY OF THE INVENTION

It is an object of this invention to provide a connector in which conductive leads may be reliably engaged with contacts within the connector housing.

It is another object of this invention to provide an electrical connector in which the forces exerted to maintain the lead in electrical engagement with the contact, are isolated from the insulative body of the connector so that creep does not lead to a failure of the interconnection.

These objects are accomplished by providing an electrical connector for electrically connecting leads to a device where the connector includes a contact having a first end for electrically engaging the lead and a second end for electrically engaging the device. This contact is enclosed within an insulative body such that the first and second ends are exposed for electrical engagement. A fastener is included to maintain the engagement between the contact and the lead. This invention being characterized in that the forces exerted by the fastener, to maintain the lead in electrical engagement with the contact, are isolated from the insulative body of the housing.

In one particular embodiment of this invention, a retention member, shown as a nut having tapered sides, is received within a complementary slot within the insulated body. The nut includes a bearing surface extending from the slot, such that the fastener captivates the lead and the contact relative the bearing surface, such that the forces exerted by the fastener act between the fastener and the nut without compressing the insulative body. In a further embodiment, it is possible to include a tab as part of the contact to engage the tapered nut in order to captivate the contact within the connector independently of the fastener. In yet another embodiment, a probe point is advantageously included at the first end of the contact, whereby a testing device may engage the contact and be interconnected with the actual circuit, as opposed to prior art devices where it would be necessary to contact the fastener.

DETAILED DESCRIPTION OF THE PREFERRED EMBODIMENT

Figure 1:
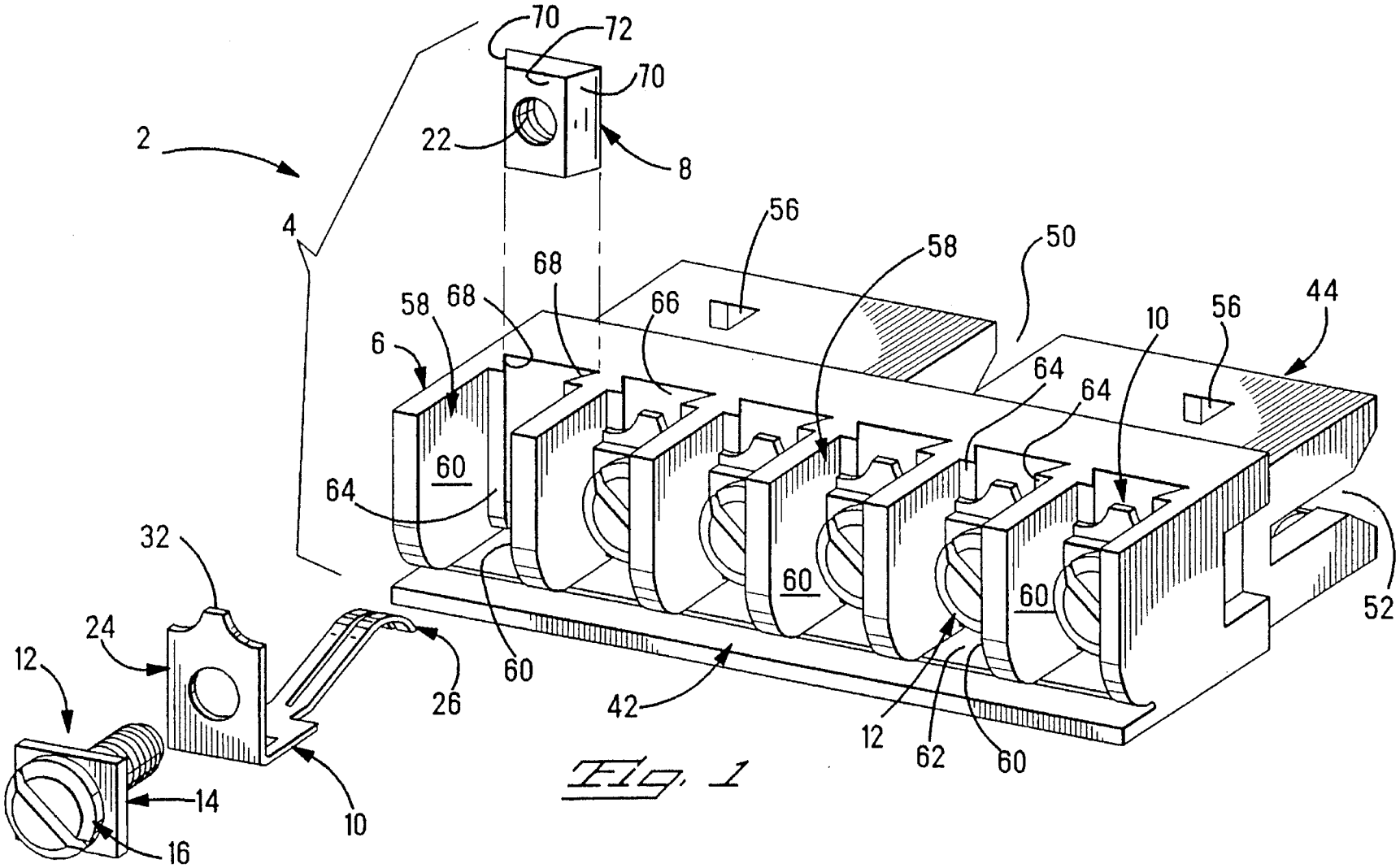
FIG. 1 is a partially-exploded, front isometric view of an electrical connector according to this invention.
Figure 2:
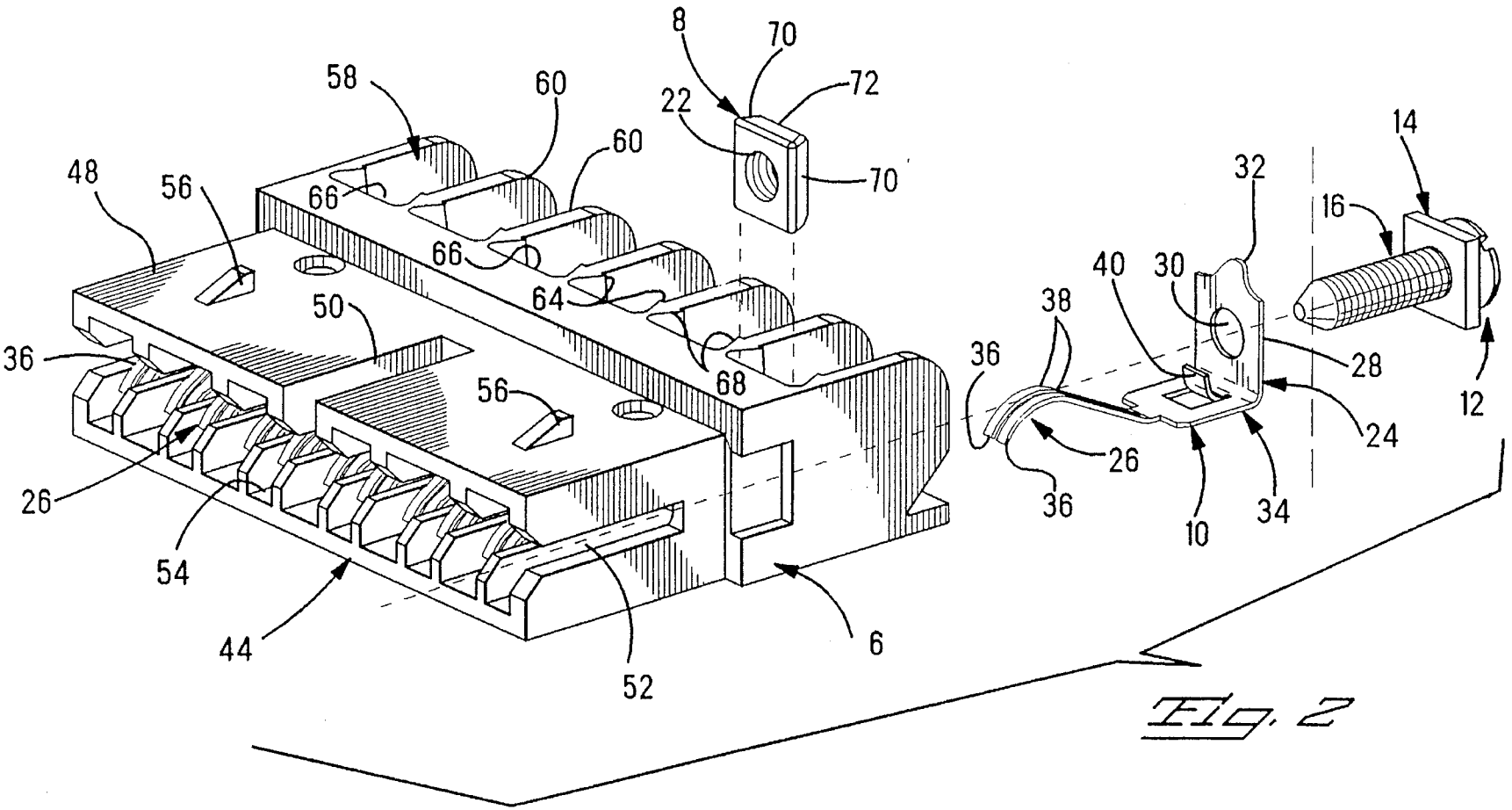
FIG. 2 is a rear isometric view of the partially-exploded connector of FIG. 1.

With reference first to FIG. 1, an electrical connector is shown generally at 2. This connector 2 includes a housing 4 having an insulative body 6 and a retention member 8, shown as a tapered nut. The connector further includes a contact 10 and a fastener 12. The fastener 12 is shown as a machine screw 16 having a head 18 and a threaded body 20. A washer 14, advantageously having a square configuration to prevent rotation, is also included as part of the fastener 12. The threaded body 20 of screw 16 is to be received in a complementary threaded aperture 22 in the retention member 8.

Figure 4:
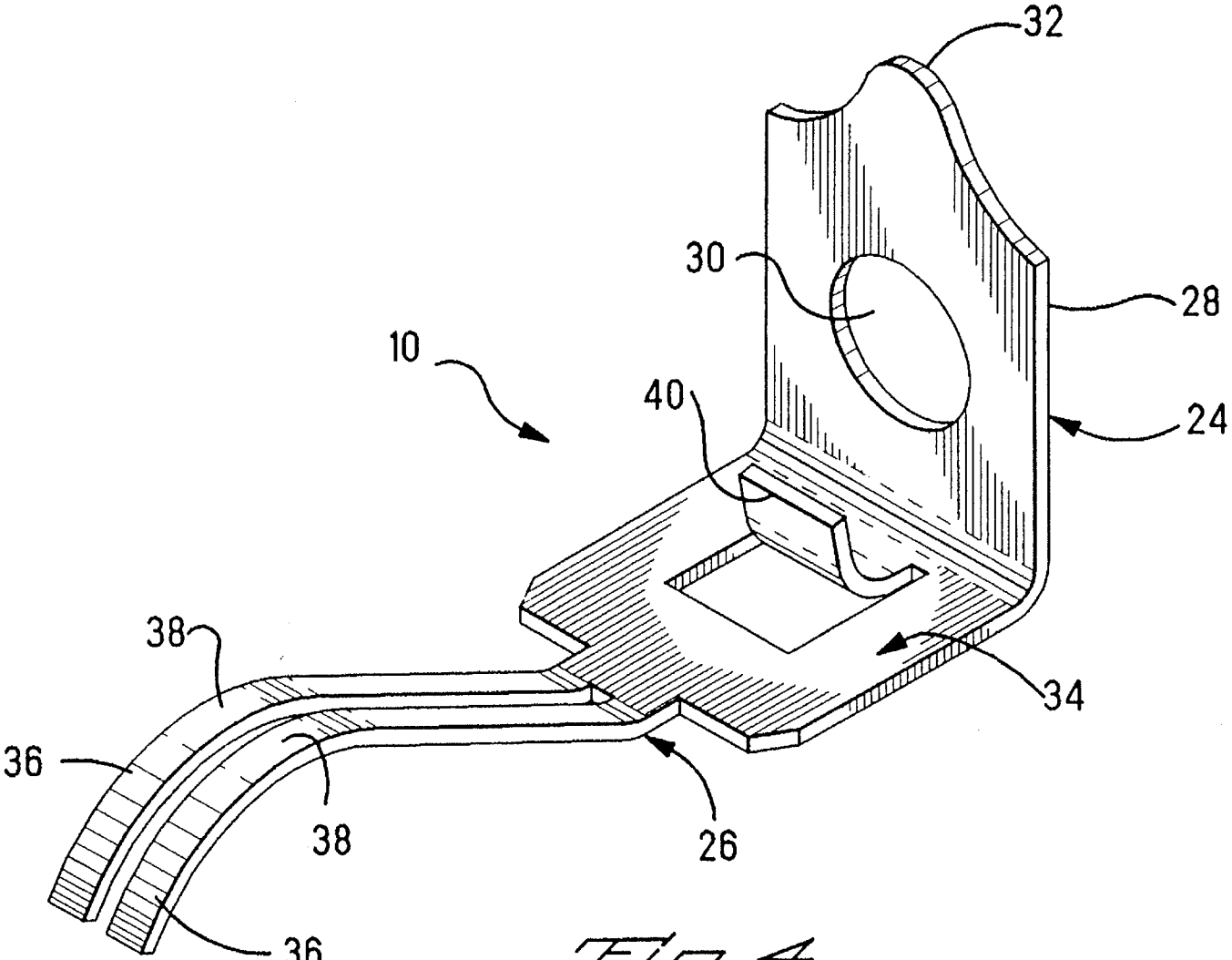
FIG. 4 is an isometric view of the contact of FIG. 1.

With reference now to FIG. 4, the contact 10 includes a first end 24 for electrically engaging a lead (not shown) and a second end 26 for electrically engaging a device (not shown), such as a printed circuit board. The first end 24 includes a upstanding wall 28 that has a opening 30 therethrough that is sized so that the threaded body 20 of the screw 16 can pass therethrough. The wall 28 also includes a probe point 32 that extends outward therefrom. The probe point 32 enables trouble shooting of the electrical interconnections by way of electrical contact directly with a testing device, as opposed to having to contact the fastener 12 in order to test the interconnection, thereby improving the accuracy of the measurement and eliminating the need to provide expensive plating upon the screw 16. The upstanding wall 28 is interconnected with the second end 26 by way of a base 34. In this embodiment, the second end 26 includes a pair of bowed contact arms 36 that are deformed to be resilient so that as conductive pads of printed circuit board pass thereover, contact surfaces 38 upon the arms 36 will make a wiping interconnection. As will be described more fully below, a tab 40 is folded upwards out of base 34.

The insulative body 6 of the housing 4 has a lead side 42 and a device side 44 interconnected by a passages 46 (FIG. 3) that extend through the body 6 so that the first end 24 of the contact 10 is disposed on the lead side 42 and the second end 26 of the contact 10 extends from the device side 44. The device side 44 includes an outer shell 48 having a keying slot 50 that could be used to assure proper mating. A principle slot 52 open to receive the device, extends longitudinally across the shell 48. Exposed within the principle slot 52 are a plurality of channels 54 within which the bowed contact arms 36 of the second end 26 of the contact 10 are disposed in order to make electrical interconnection with the device. The outer shell 48 further includes locking members 56 which would secure the connector 2 to the device. The lead side 42 includes 6 ports 58 having two adjacent open sides, two side walls 60, a base 62 and a back wall 64. The back wall 64 includes a seat, such as dove-tail slot 66 that is also open on one end and includes tapered walls 68. This slot 66 is configured to receive and retain the retention member 8.

The retention member 8 is configured to fit within slot 66 of the insulative body 6. In this embodiment, the retention member 8 is a tapered nut formed of a short length of material having a threaded aperture 22 therethrough to threadably receive the threaded body 20 of fastener 12. Two of the side walls 70 of retention member 8 are complementarily tapered with respect to the tapered walls 68 of slot 66. The retention member 8 further includes a bearing surface 72 through which the threaded aperture 22 extends. The retention member 8 is configured so that when the complementarily tapered side walls 70 would be against the tapered walls 68 of slot 66, the bearing surface 72 would extend beyond back wall 64 into the port 58, thereby assuring that the forces exerted by the fastener 12 to hold the lead in electrical engagement with the contact 10 are isolated from the insulative body 6, as is described below.

Figure 3:
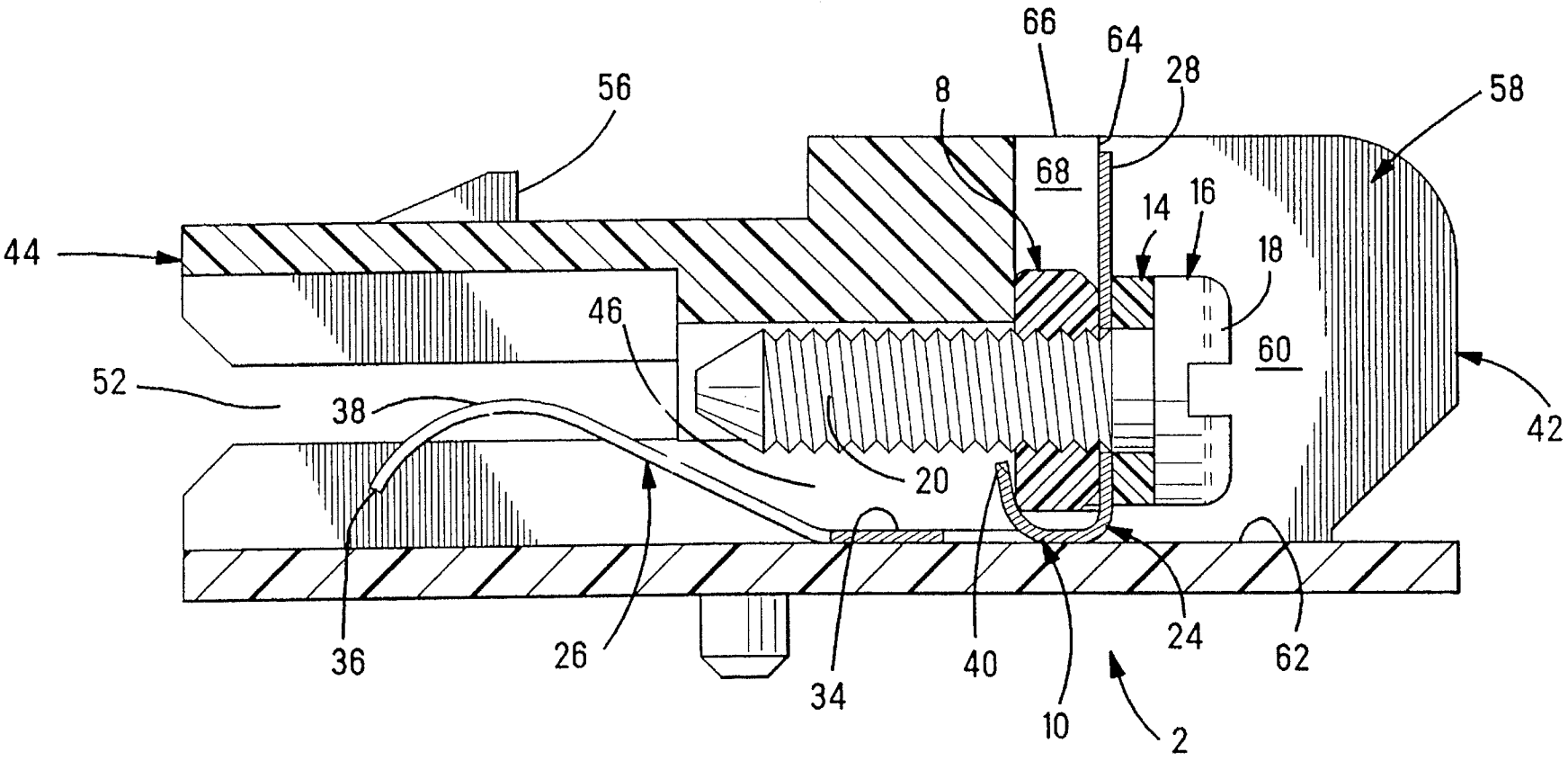
FIG. 3 is a sectional view along lines 3—3 of FIG. 2.

The components described above are assembled into the electrical connector 2 as follows. First, the contact 10 is inserted into the insulative body 6 from the lead side 42 such that the bowed contact arms 36 extend through passage 46 and into channels 54 of the device side 44. Next, the retention member 8 is inserted into slot 66 such that the tapered walls 68 of the slot and the complementary tapered side walls 70 of the retention member 8 correspond. Where the contact 10 includes tab 40, the retention member 8 may be fitted between the upstanding wall 28 and the tab 40 in order to lock the contact in place relative to the insulative body 6, this is best seen in FIG. 3. Now, the threaded body 20 of screw 16 of fastener 12 is received within the complementary threaded aperture 22 of the retention member 8. The lead (not shown), or a terminal affixed thereto, may be placed between the head 18 of screw 16 and the wall 28 of contact 10 so that as the screw 16 is tightened, the lead will be retained between the contact 10 and the head 18 of screw 16. As the bearing surface 72 extends beyond the back wall 64 of the ports 58 in the insulative body 6, when the fastener 12 is fully tightened, the lead will be compressed between the head 18 of screw 16 and the upstanding wall 28 of contact 10 while the upstanding wall 28 bears against the bearing surface 72 of the retention member 8 without loading the insulative body 6. Where the retention member 8 is metal, this provides for full metal-to-metal interconnection which is resistant to the effects of creep. Furthermore, the forces exerted to maintain the lead in electrical engagement with the contact, are isolated from the insulative body as the upstanding wall 28 of the contact 10, the square washer 14 of the fastener 12, and the lead are all compressed between the head 18 of screws 16 and the bearing surface 72 of retention member 8. All of which is retained within the insulative body 6 by way of the interaction of tapered walls 68 within dove-tail slot 66 and their complementary tapered side walls 70 of the retention member 8.

Advantageously, an electrical connector 2 is provided for interconnecting leads to another device where the electrical connector 2 has a contact 10 within a housing 4 and a fastener 12 to maintain engagement between the contact 10 and the lead where the forces exerted by the fastener 12 to maintain the lead in electrical engagement with the contact, are isolated from the insulative body 6, thereby assuring a reliable electrical interconnection. Furthermore, a metal-to-metal interconnection may be formed that is highly resistant to the effects of creep. Additionally, a probe point 32 may be included as part of the first end 24 of the contact 10 so that trouble shooting may be preformed in a manner that directly tests the interconnection. Finally, the contact 10 may include a tab 40 that is engageable with the retention member 8 to retain the contact 10 within the housing 4 independent of the fastener 12.

We claim:

1. An electrical connector for connecting electrical leads to a mating component comprising:

a body having a lead side and a device side with a passageway therebetween, the lead side including a port in communication with the passageway and having a slot disposed in a wall thereof;

a contact disposed in the body and extending through the passageway such that a first end of the contact is disposed in the port of the lead side and the second end is exposed on the device side for mating with the component;

a retention member positioned within the slot; and, a fastener for connecting the lead to the first end of the contact in response to tightening thereof, where the fastener is connected to the retention member and the first end of the contact is captivated therewith the fastener being tightenable relative the retention member independent of an exertion of a compressive force on the body; whereby the lead is electrically connected to the first end on the contact.

2. The electrical connector of claim 1, wherein the second end of the contact includes a spring member with a contact surface therealong for a wiping interconnection with the mating component.

3. The electrical connector of claim 2, wherein the body includes a principle slot on the device side for receiving the mating component and positioning the mating component in a manner that enables the second side of the contact to engage the mating component.

4. The electrical connector of claim 2, wherein the contact includes a base portion between the first and second ends, the base including a tab extending therefrom such that the retention member is captivated between the tab and the first end of the contact.

5. The electrical connector of claim 2, wherein the connector includes a plurality of ports.

6. The electrical connector of claim 1, wherein the first end of the contact includes a probe point extending above the fastener for electrical contact.

7. The electrical connector of claim 1, wherein the slot in the port has dove-tail sides and the retention member is complementarily formed therewith to be retained therein.

8. The electrical contact of claim 7, wherein the retention member includes a bearing surface exposed in the slot and extending there beyond and into the port.

9. The electrical connector of claim 8, wherein the retention member includes a threaded hole and the fastener includes a threaded body formed complementary to the threaded opening of the retention member and received therein.

10. The electrical connector of claim 1, wherein a base portion is located between the first end and the second end, where the first end has a plate-like form generally perpendicular to the base with an opening therethrough and the second end extends outward from the base opposite the first end and includes a bowed portion having a contact surface at the apex thereof for forming a wiping electrical engagement with the device as the device and the connector are brought together.

11. An electrical connector for electrically connecting a lead to a mating device, the connector comprising:

a contact having a first end for electrical engagement with the lead, a second end for electrical engagement with the mating device, and a base portion therebetween;

a housing having an insulative body with a device side and a lead side with a passageway extending therebetween, the lead side includes a part, where the lead is to be connected, that has a seat thereat, the contact being positioned in the body such that the base is in the passageway while the first end is exposed at the part for electrical engagement with the lead and the second end is exposed on the device side for electrical engagement with the device;

a retention member disposed in the seat and including a bearing surface that extends outward beyond the seat of the part; and a fastener connected to the retention member and retaining the first end of the contact therewith, whereby a terminal block structure is defined for connecting the lead to the contact by way of tightening the fastener, the fastener being tightenable in a manner that forces exerted as a result thereof are isolated from the body.

12. The electrical connector of claim 11, wherein the second end of the contact includes a contact arm having a contact surface thereupon for wiping engagement with the mating device.

13. The electrical connector of claim 12, wherein the device side includes a principle slot for receiving the device, the contact surface being exposed within said principle slot.

14. The electrical connector of claim 13, wherein the connector includes a plurality of contacts arranged in a row, the second end of the contacts being received in channels at the device side.

15. The electrical connector of claim 11, wherein the seat is a slot having dove tail opposing side walls complementary to corresponding side-walls on the retention member.

16. The electrical connector of claim 15, wherein the base portion of the contact includes a tab spaced from the first end of the contact, the retention member being received between the tab and the first end of the contact.

17. The electrical connector of claim 16, wherein the fastener is a screw and the retention member has an opening for receiving the screw, the lead being captivated therebetween.

* * * * *